US010475463B2

(12) United States Patent
Tsukagoshi

(10) Patent No.: US 10,475,463 B2
(45) Date of Patent: Nov. 12, 2019

(54) TRANSMISSION DEVICE, TRANSMISSION METHOD, RECEPTION DEVICE, AND RECEPTION METHOD FOR AUDIO STREAMS

(71) Applicant: SONY CORPORATION, Tokyo (JP)

(72) Inventor: Ikuo Tsukagoshi, Tokyo (JP)

(73) Assignee: SONY CORPORATION, Tokyo (JP)

( * ) Notice: Subject to any disclaimer, the term of this patent is extended or adjusted under 35 U.S.C. 154(b) by 14 days.

(21) Appl. No.: 15/540,306

(22) PCT Filed: Jan. 29, 2016

(86) PCT No.: PCT/JP2016/052610
§ 371 (c)(1),
(2) Date: Jun. 28, 2017

(87) PCT Pub. No.: WO2016/129412
PCT Pub. Date: Aug. 18, 2016

(65) Prior Publication Data

US 2018/0005640 A1 Jan. 4, 2018

(30) Foreign Application Priority Data

Feb. 10, 2015 (JP) ..... 2015-024240

(51) Int. Cl.
*G10L 19/16* (2013.01)
*G10L 19/008* (2013.01)

(52) U.S. Cl.
CPC ..... *G10L 19/167* (2013.01); *G10L 19/008* (2013.01)

(58) Field of Classification Search
CPC ..... G10L 19/167; G10L 19/008
(Continued)

(56) References Cited

U.S. PATENT DOCUMENTS 6,633,592 B1 10/2003 Takahashi
2006/0256701 A1 11/2006 Takakuwa
(Continued)

FOREIGN PATENT DOCUMENTS

JP 2001-292432 A 10/2001
JP 2009-177706 A 8/2009
(Continued)

OTHER PUBLICATIONS

Steve Vernon, et al., "An Integrated Multichannel Audio Coding System for Digital Television Distribution and Emission" Proc. 108th Convention of the AES, Feb. 19, 2000, pp. 1-12 and Cover Page.

*Primary Examiner* — Nicholas R Taylor
*Assistant Examiner* — Chong G Kim
(74) *Attorney, Agent, or Firm* — Oblon, McClelland, Maier & Neustadt, L.L.P.

(57) ABSTRACT

It is attempted to reduce the processing load of a receiver at the time of integrating plural audio streams.

A predetermined number of audio streams are generated, and a container of a predetermined format including these predetermined number of audio streams is transmitted. The audio streams are constituted by an audio frame including a first packet that includes encoded data as payload information and a second packet that includes configuration information representing a configuration of the payload information of this first packet as payload information. Common index information is inserted in payloads of related first packet and second packet.

7 Claims, 10 Drawing Sheets

(58) Field of Classification Search
USPC ..... 709/243
See application file for complete search history.

(56) References Cited

U.S. PATENT DOCUMENTS

| | | | | |
|---|---|---|---|---|
| 2007/0165676 | A1* | 7/2007 | Kato | H04N 7/52 370/487 |
| 2010/0017002 | A1* | 1/2010 | Oh | G10L 19/008 700/94 |
| 2012/0030253 | A1 | 2/2012 | Katsumata | |
| 2013/0287364 | A1 | 10/2013 | Katsumata | |
| 2015/0199973 | A1* | 7/2015 | Borsum | H04S 3/002 704/500 |
| 2016/0019898 | A1* | 1/2016 | Schreiner | G10L 19/0017 704/500 |
| 2016/0125887 | A1* | 5/2016 | Purnhagen | G10L 19/008 381/22 |
| 2017/0223429 | A1* | 8/2017 | Schreiner | G10L 19/00 |
| 2017/0249944 | A1* | 8/2017 | Tsukagoshi | G10L 19/008 |
| 2017/0263259 | A1* | 9/2017 | Tsukagoshi | G10L 19/018 |
| 2017/0289720 | A1* | 10/2017 | Tsukagoshi | H04S 3/008 |
| 2017/0302995 | A1* | 10/2017 | Tsukagoshi | H04N 21/44209 |

FOREIGN PATENT DOCUMENTS

| | | | |
|---|---|---|---|
| JP | 2012-33243 | A | 2/2012 |
| JP | 2014-520491 | A | 8/2014 |
| WO | WO 97/44955 | A1 | 11/1997 |
| WO | WO 2004/066303 | A1 | 8/2004 |

* cited by examiner

TRANSMISSION DEVICE, TRANSMISSION METHOD, RECEPTION DEVICE, AND RECEPTION METHOD FOR AUDIO STREAMS

TECHNICAL FIELD

The present technology is related to a transmission device, a transmission method, a receiving device, and a receiving method, specifically to a transmission device and so forth that use audio streams.

BACKGROUND ART

Conventionally, a technology of performing rendering by mapping encoded sample data on speakers present on arbitrary positions on the basis of metadata has been proposed as a three-dimensional (3D) audio technology (for example, see Patent Document 1).

CITATION LIST

Patent Document

Patent Document 1: Japanese Patent Application Laid-Open (Translation of PCT Application) No. 2014-520491

SUMMARY OF THE INVENTION

Problems to be Solved by the Invention

For example, enabling audio reproduction with a better realistic feeling for a receiver by transmitting object data constituted by encoded sample data and metadata with channel data of such as 5.1 channels or 7.1 channels can be considered. Conventionally, it has been proposed to transmit, to a receiver, an audio stream including encoded data obtained by encoding channel data and object data via an encoding method for 3D audio (MPEG-H 3D Audio).

An audio frame constituting this audio stream is configured to include a "Frame" packet (a first packet) including encoded data as payload information and a "Config" packet (a second packet) including configuration information representing a configuration of the payload information of this "Frame" packet as payload information.

Conventionally, information of association with a corresponding "Config" packet is not inserted in the "Frame" packet. Therefore, in order to appropriately perform decoding processing, the order of plural "Frame" packets included in the audio frame is restricted in accordance with a type of encoded data included in the payload. Accordingly, for example, when a receiver integrates plural audio streams into one audio stream, it is required to comply with this restriction and thus the processing load increases.

An object of the present technology is to reduce the processing load of a receiver at the time of integrating plural audio streams.

Solutions to Problems

A concept of the present technology lies in a transmission device including an encoding unit configured to generate a predetermined number of audio streams, and a transmission unit configured to transmit a container of a predetermined format including the predetermined number of audio streams. The audio streams are constituted by an audio frame including a first packet that includes encoded data as payload information and a second packet that includes configuration information representing a configuration of the payload information of the first packet as payload information. Common index information is inserted in payloads of the first packet and the second packet that are related.

In the present technology, a predetermined number of audio streams are generated by the encoding unit. The audio streams are constituted by an audio frame including a first packet that includes encoded data as payload information and a second packet that includes configuration information representing a configuration of the payload information of this first packet as payload information. For example, a configuration in which the encoded data that the first packet includes as payload information is encoded channel data or encoded object data may be employed. Common index information is inserted in payloads of related first packet and second packet.

A container of a predetermined format including these predetermined number of audio streams is transmitted by the transmission unit. For example, the container may be a transport stream (MPEG-2 TS) employed in a digital broadcast standard. Alternatively, the container may be, for example, a container of MP4 used in distribution via the Internet or of another format.

As described above, in the present technology, common index information is inserted in payloads of related first packet and second packet. Therefore, in order to appropriately perform decoding processing, the order of plural first packets included in the audio frame is no longer restricted by a regulation of the order corresponding to a type of encoded data included in the payload. Therefore, for example, when a receiver integrates plural audio streams into one audio stream, it is not required to comply with the regulation of the order, and it can be attempted to reduce the processing load.

In addition, another concept of the present technology lies in a receiving device including a receiving unit configured to receive a container of a predetermined format including a predetermined number of audio streams, in which the audio streams are constituted by an audio frame including a first packet that includes encoded data as payload information and a second packet that includes configuration information representing a configuration of the payload information of the first packet as payload information, and common index information is inserted in payloads of the first packet and the second packet that are related, a stream integration unit configured to take out a part or all of the first packet and the second packet from the predetermined number of audio streams and integrate the part or all of the first packet and the second packet into one audio stream by using the index information inserted in payload portions of the first packet and the second packet, a processing unit configured to process the one audio stream.

In the present technology, a container of a predetermined format including these predetermined number of audio streams is transmitted by the receiving unit. The audio streams are constituted by an audio frame including a first packet that includes encoded data as payload information and a second packet that includes configuration information representing a configuration of the payload information of this first packet as payload information. Moreover, common index information is inserted in payloads of related first packet and second packet.

Apart or all of the first packet and the second packet is taken out from a predetermined number of audio streams by the stream integration unit, and is integrated into one audio stream by using index information inserted in payload portions of the first packet and the second packet. In this case, since common index information is inserted in payloads of related first packet and second packet, the order of plural first packets included in the audio frame is not restricted by the regulation of the order corresponding to a type of encoded data included in the payloads, and integration can be performed without decomposing the composition of each audio stream.

The one audio stream is processed by the processing unit. For example, the processing unit may be configured to perform decoding processing on the one audio stream. In addition, the processing unit may be configured to transmit the one audio stream to an external device.

As described above, in the present technology, a part or all of the first packet and the second packet taken out from a predetermined number of audio streams is integrated into one audio stream by using index information inserted in payload portions of the first packet and the second packet. Therefore, integration can be performed without decomposing the composition of each audio stream, and it can be attempted to reduce the processing load.

Effects of the Invention

According to the present technology, the processing load of a receiver to integrate plural audio streams can be reduced. To be noted, effects described in the present description are merely shown as examples and not limiting, and additional effects may be also present.

MODE FOR CARRYING OUT THE INVENTION

A mode for carrying out the invention (hereinafter referred to as an "exemplary embodiment") will be described below. To be noted, the description will be given in the following order:

1. Exemplary Embodiment; and
2. Modification Example.

1. Exemplary Embodiment

[Exemplary Configuration of Communication System]

Figure 1:
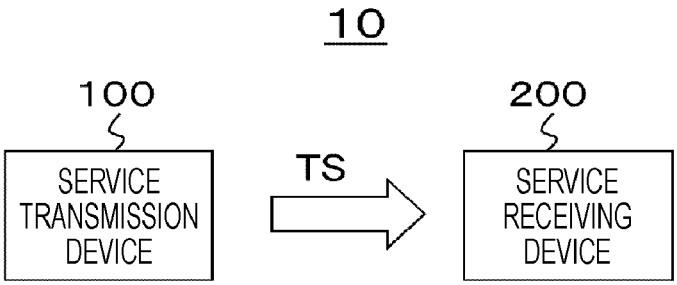
FIG. 1 is a block diagram illustrating an exemplary configuration of a communication system serving as an exemplary embodiment.

FIG. 1 illustrates an exemplary configuration of a communication system 10 serving as an exemplary embodiment. This communication system 10 is constituted by a service transmission device 100 and a service receiving device 200. The service transmission device 100 transmits a transport stream TS via a broadcasting wave or on a packet via a network. This transport stream TS includes a predetermined number of, that is, one or plural audio streams in addition to a video stream.

Here, an audio stream is constituted by an audio frame that includes a first packet (a "Frame" packet) including encoded data as payload information and a second packet (a "Config" packet) including configuration information representing a configuration of the payload information of this first packet as payload information, and common index information is inserted in payloads of related first packet and second packet.

Figure 2:
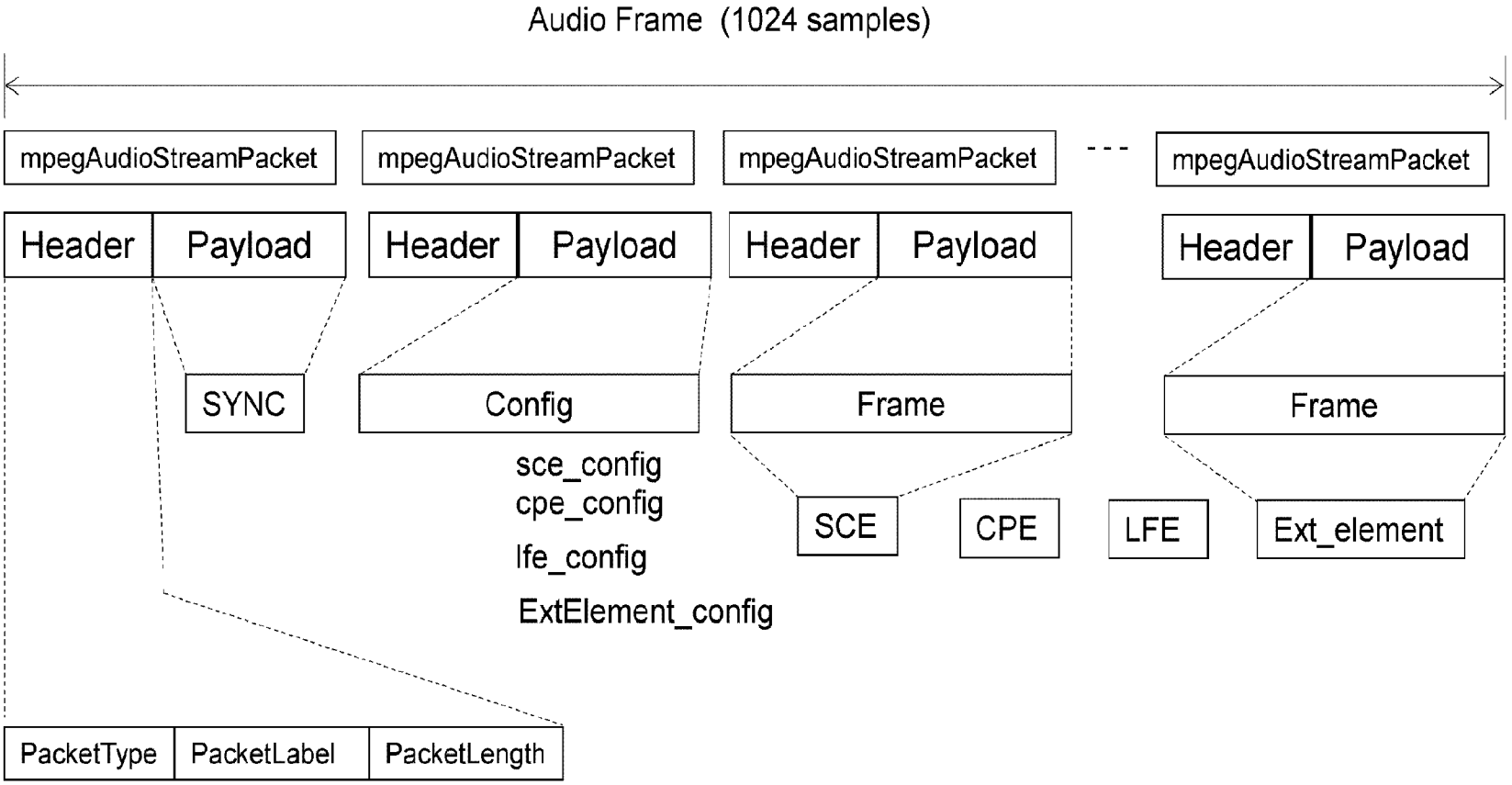
FIG. 2 is a diagram illustrating a structure of an audio frame (1024 samples) in transmission data of 3D audio.

FIG. 2 illustrates an exemplary structure of an audio frame (1024 samples) in transmission data of 3D audio used in this exemplary embodiment. This audio frame is constituted by plural MPEG audio stream packets. Each MPEG audio stream packet is constituted by a header and a payload.

A header includes information such as a packet type, a packet label, and a packet length. Payload information defined by the packet type of the header is assigned to the payload. As this payload information, there are "SYNC" corresponding to a synchronization starting code, "Frame" that is actual data of transmission data of 3D audio, and "Config" representing the configuration of this "Frame".

"Frame" includes encoded channel data and encoded object data constituting transmission data of 3D audio. To be noted, there is a case where only the encoded channel data is included and a case where only the encoded object data is included.

Here, encoded channel data is constituted by encoded sample data such as a single channel element (SCE), a channel pair element (CPE), and a low frequency element (LFE). In addition, encoded object data is constituted by encoded sample data of a single channel element (SCE) and metadata for performing rendering by mapping the encoded sample data of an SCE on speakers present at arbitrary positions. This metadata is included as an extension element (Ext_element).

In this exemplary embodiment, identification information for identifying related "Config" is inserted in each "Frame". That is, common index information is inserted in related "Frame" and "Config".

Figure 3:
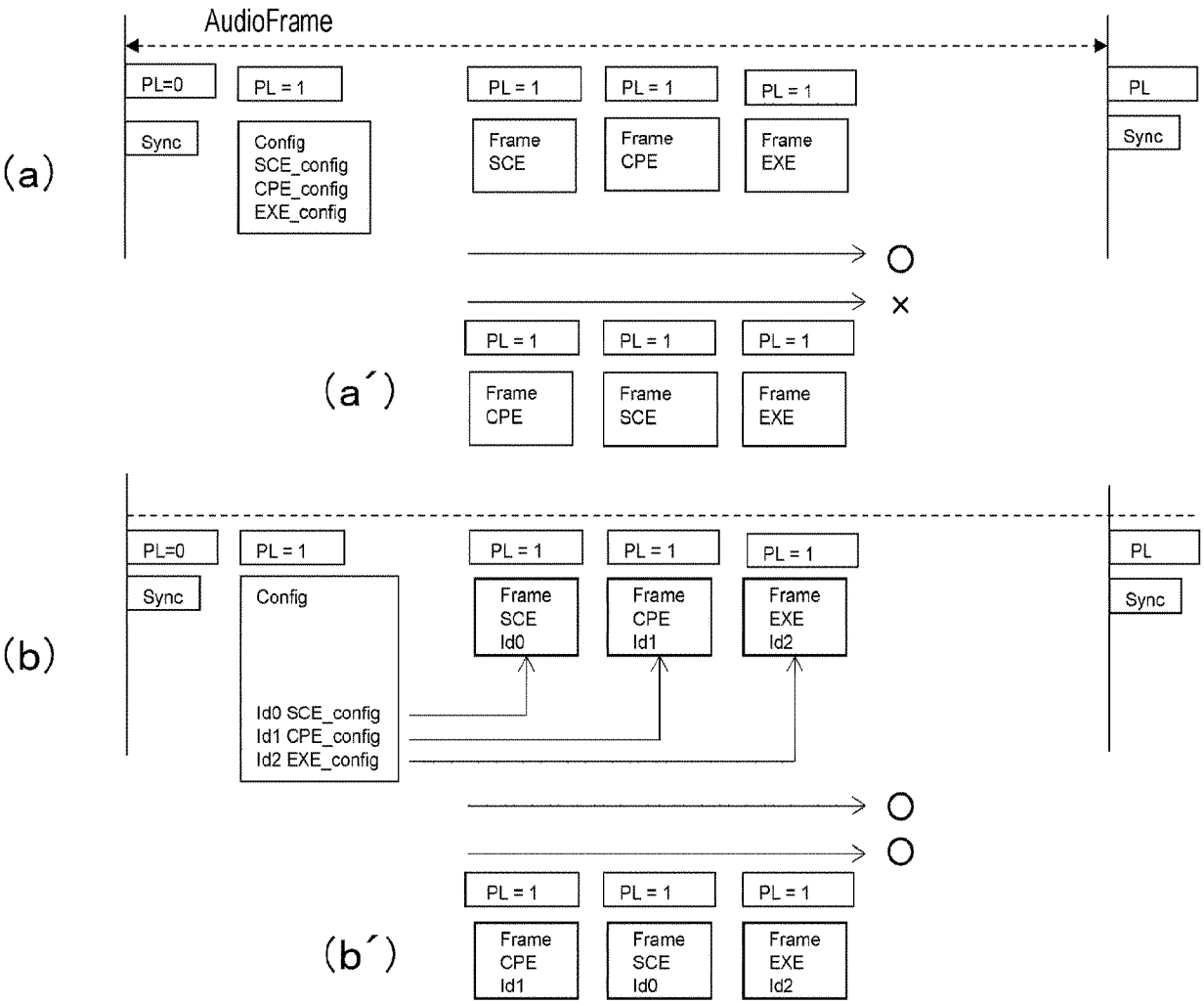
FIG. 3 is a diagram illustrating exemplary configurations of an audio stream according to a conventional embodiment and the exemplary embodiment.

FIG. 3(*a*) illustrates an exemplary configuration of an conventional audio stream. Configuration information "SCE_config" corresponding to a "Frame" element of SCE is present as "Config". In addition, configuration information "CPE_config" corresponding to a "Frame" element of CPE is present as "Config". Further, configuration information "EXE_config" corresponding to a "Frame" element of EXE is present as "Config".

In this case, information associating "Config" corresponding to each element with "Frame" of each element is not inserted in the "Config" or "Frame". Therefore, to perform decoding processing appropriately, the order of the elements is defined as SCE→CPE→EXE or the like. That is, such an order as CPE→SCE→EXE illustrated in FIG. 3(*a*') cannot be set.

FIG. 3(*b*) illustrates an exemplary configuration of an audio stream according to this exemplary embodiment. Configuration information "SCE_config" corresponding to a "Frame" element of SCE is present as "Config", and "Id0" is attached to this configuration information "SCE_config" as an element index.

In addition, configuration information "CPE_config" corresponding to a "Frame" element of CPE is present as "Config", and "Id1" is attached to this configuration information "CPE_config" as an element index. In addition, configuration information "EXE_config" corresponding to a "Frame" element of EXE is present as "Config", and "Id2" is attached to this configuration information "EXE_config" as an element index.

In addition, an element index common with related "Config" is attached to each "Frame". That is, "Id0" is attached to "Frame" of SCE as an element index. In addition, "Id1" is attached to "Frame" of CPE as an element index. In addition, in addition, "Id2" is attached to "Frame" of EXE as an element index.

In this case, "Config" and "Frame" are associated for each element by index information, and thus the order of elements is no longer limited by the regulation of the order. Therefore, the order may be set not only to SCE→CPE→EXE but also to CPE→SCE→EXE illustrated in FIG. 3(*b*').

Figure 4:
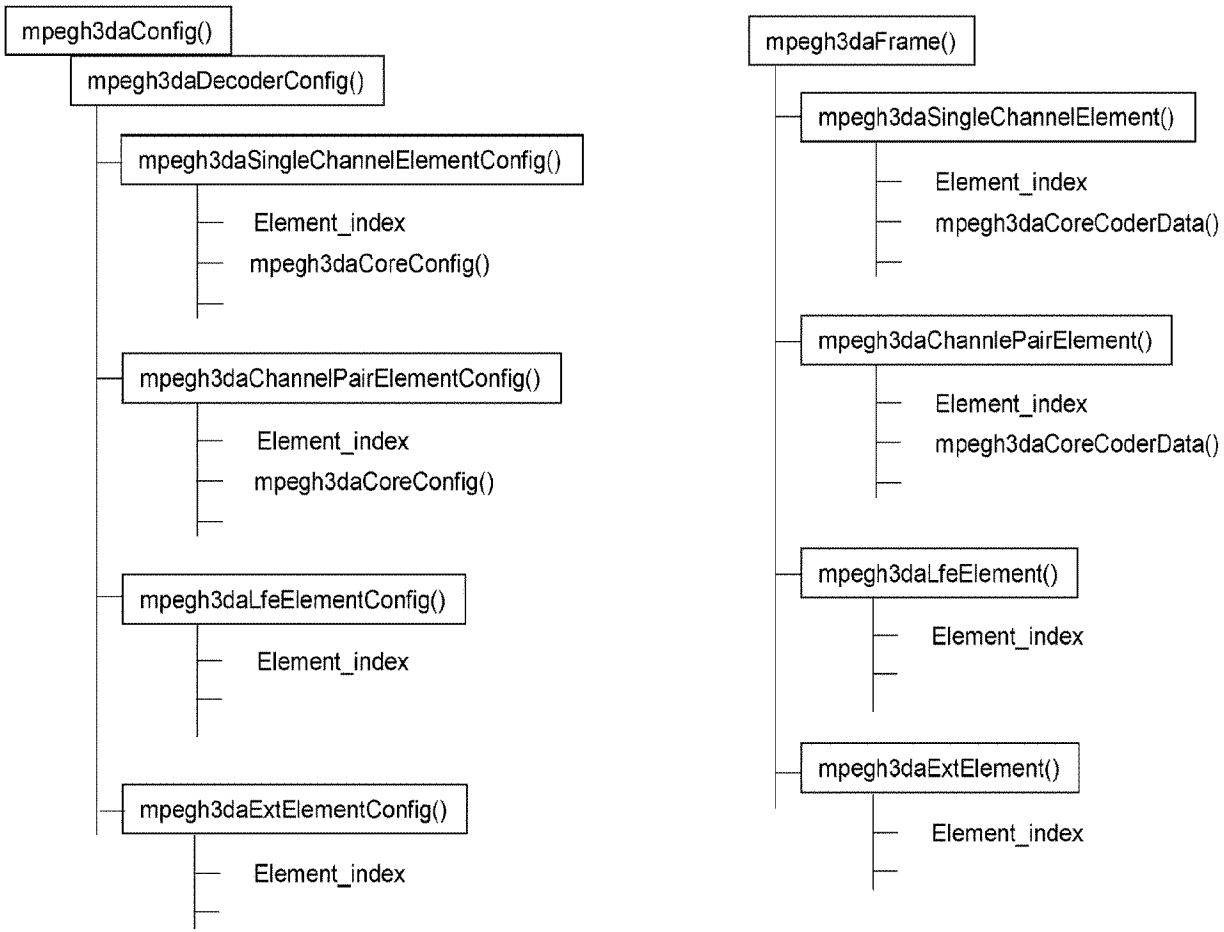
FIG. 4 is a diagram schematically illustrating exemplary configurations of "Config" and "Frame".

FIG. 4(*a*) schematically illustrates an exemplary configuration of "Config". The upper most concept is "mpeg3daConfig( )", and "mpeg3daDecoderConfig( )" for decoding is present thereunder. Further, "Config( )"s corresponding to respective elements to be stored in "Frame" are present thereunder, and an element index (Element_index) is inserted in each of these.

For example, "mpegh3daSingleChannelElement Config( )" corresponds to an SCE element, "mpegh3daChannelPairElementConfig( )" corresponds to a CPE element, "mpegh3daLfeElementConfig( )" corresponds to an LFE element, and "mpegh3daExtElementConfig( )" corresponds to an EXE element.

FIG. 4(*b*) schematically illustrates an exemplary configuration of "Frame". The upper most concept is "mpeg3daFrame( )", and "Element( )"s that are substance of respective elements are present thereunder, and an element index (Element_index) is inserted in each of these. For example, "mpegh3daSingleChannelElement( )" is an SCE element, "mpegh3daChannlePairElement( )" is a CPE element, "mpegh3daLfeElement" is an LFE element, and "mpegh3daExtElement( )" is an EXE element.

Figure 5:
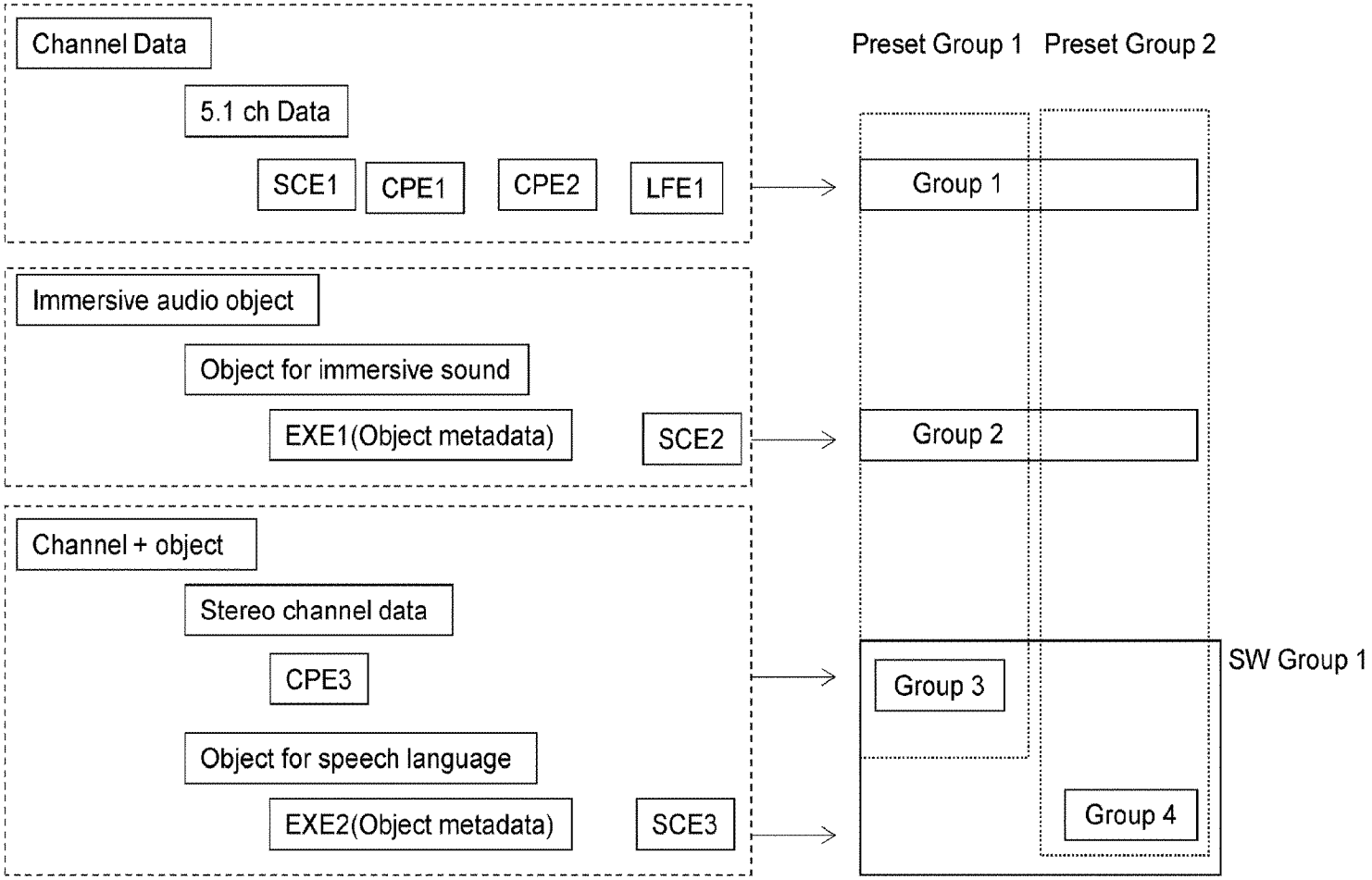
FIG. 5 is a diagram illustrating an exemplary configuration of transmission data of 3D audio.

FIG. 5 illustrates an exemplary configuration of transmission data of 3D audio. In this example, a configuration including first data constituted by just encoded channel data, second data constituted by just encoded object data, and third data constituted by encoded channel data and encoded object data is shown.

The encoded channel data of the first data is encoded channel data of 5.1 channels, and is constituted by respective encoded sample data of SCE1, CPE1, CPE2, and LFE1.

The encoded object data of the second data is encoded data of an immersive audio object. This encoded immersive audio object data is encoded object data for immersive sound, and is constituted by encoded sample data SCE2 and metadata EXE1 for performing rendering by mapping the encoded sample data SCE2 on speakers present at arbitrary positions.

The encoded channel data included in the third data is encoded channel data of 2 channels (stereo) and is constituted by encoded sample data of CPE3. In addition, the encoded object data included in this third data is encoded speech language object data and is constituted by encoded sample data SCE3 and metadata EXE2 for performing rendering by mapping the encoded sample data SCE3 on speakers present at arbitrary positions.

Encoded data is classified into types in accordance with a concept of groups. In an illustrated example, the encoded channel data of 5.1 channels is set as a group 1, the encoded immersive audio object data is set as a group 2, the encoded channel data of 2 channels (stereo) is set as a group 3, and the encoded speech language object data is set as a group 4.

In addition, groups among which selection can be performed by the receiver are registered in a switch group (SW Group) and encoded. In addition, groups are collectively set as a preset group, and can be reproduced in accordance with a use case. In the illustrated example, the group 1, group 2, and group 3 are collectively set as a preset group 1, and the group 1, group 2, and group 4 are collectively set as a preset group 2.

Referring back to FIG. 1, the service transmission device 100 transmits transmission data of 3D audio including encoded data of plural groups as described above in one stream or in multiple streams. In this exemplary embodiment, the transmission is performed in three streams.

Figure 6:
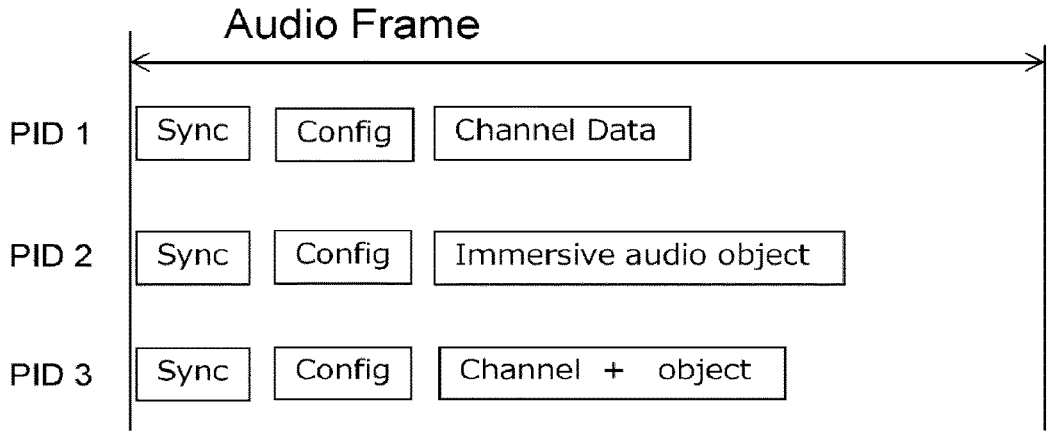
FIG. 6 is a diagram schematically illustrating an exemplary configuration of an audio frame in a case of performing transmission in three streams.

FIG. 6 schematically illustrates an exemplary configuration of an audio frame in a case where transmission is performed in three streams in the exemplary configuration of the transmission data of 3D audio of FIG. 5. In this case, a first stream identified by PID1 includes the first data constituted by just encoded channel data with "SYNC" and "Config".

In addition, a second stream identified by PID2 includes the second data constituted by just encoded object data with "SYNC" and "Config". In addition, a third stream identified by PID3 includes the third data constituted by encoded channel data and encoded object data with "SYNC" and "Config".

Referring back to FIG. 1, the service receiving device 200 receives the transport stream TS transmitted from the service transmission device 100 via a broadcasting wave or on a packet via a network. This transport stream TS includes a predetermined number of, in this exemplary embodiment, three audio streams in addition to a video stream.

As described above, an audio stream is constituted by an audio frame that includes a first packet (a "Frame" packet) including encoded data as payload information and a second packet (a "Config" packet) including configuration information representing a configuration of the payload information of this first packet as payload information, and common index information is inserted in payloads of related first packet and second packet.

The service receiving device 200 takes out a part or all of the first packet and the second packet from the three audio streams, and integrates the part or all of the first packet and the second packet into one audio stream by using index information inserted in a payload portion of the first packet and the second packet. Then, the service receiving device 200 processes this one audio stream. For example, this one audio stream is subjected to decoding processing and audio output of 3D audio is obtained. In addition, for example, this one audio stream is transmitted to an external device.

[Stream Generation Unit of Service Transmission Device]

Figure 7:
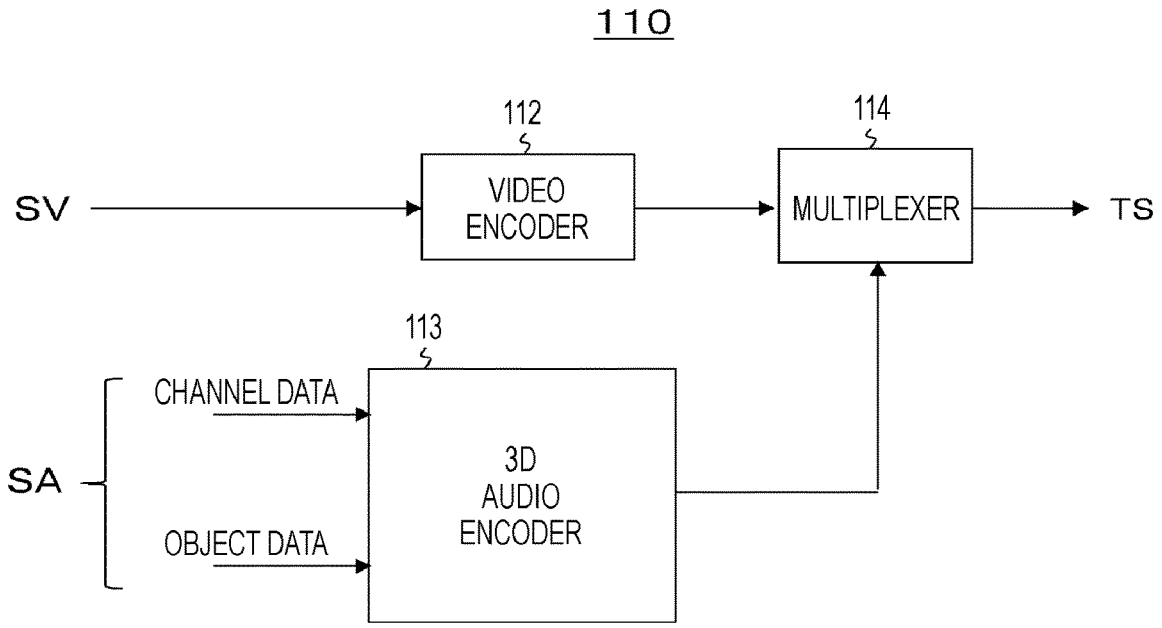
FIG. 7 is a block diagram illustrating an exemplary configuration of a stream generation unit included in a service transmission device.

FIG. 7 illustrates an exemplary configuration of a stream generation unit 110 included in the service transmission device 100. This stream generation unit 110 includes a video encoder 112, a 3D audio encoder 113, and a multiplexer 114.

The video encoder 112 inputs video data SV, and encodes this video data SV to generate a video stream (video elementary stream). The 3D audio encoder 113 inputs required channel data and object data as audio data SA.

The 3D audio encoder 113 encodes the audio data SA to obtain transmission data of 3D audio. As illustrated in FIG. 5, this transmission data of 3D audio includes the first data (data of the group 1) constituted by just encoded channel data, the second data (data of the group 2) constituted by just encoded object data, and the third data (data of the groups 3 and 4) constituted by encoded channel data and encoded object data.

Moreover, the 3D audio encoder 113 generates a first audio stream (Stream 1) including the first data, a second audio stream (Stream 2) including the second data, and a third audio stream (Stream 3) including the third data (see FIG. 6).

Figure 8:
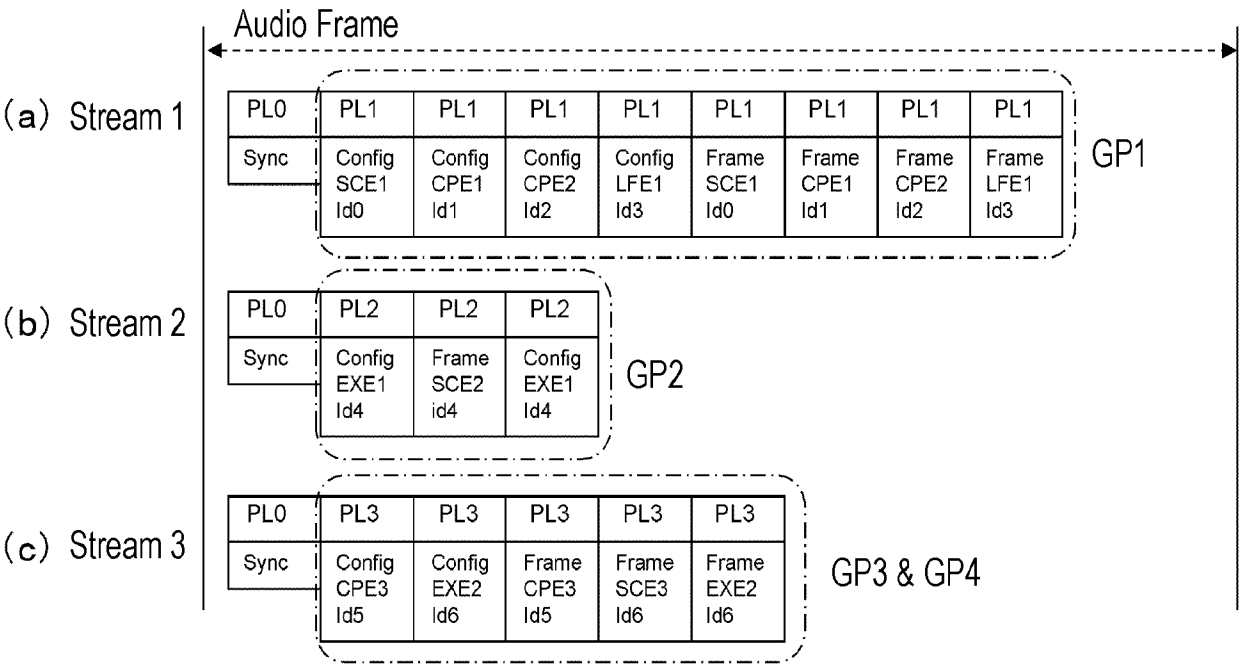
FIG. 8 is a diagram for description of an audio frame constituting each audio stream.

FIG. 8(*a*) illustrates a configuration of an audio frame constituting the first audio stream (Stream 1). There are "Frame"s of SCE1, CPE1, CPE2, and LFE1, and "Config"s corresponding to respective "Frame"s. "Id0" is inserted as a common element index in the "Frame" of SCE1 and the "Config" corresponding thereto. "Id1" is additionally inserted as a common element index in the "Frame" of CPE1 and the "Config" corresponding thereto.

In addition, "Id2" is inserted as a common element index in the "Frame" of CPE2 and the "Config" corresponding thereto. In addition, "Id3" is inserted as a common element index in the "Frame" of LFE1 and the "Config" corresponding thereto. To be noted, packet label (PL) values of the "Config"s and "Frame"s in this first audio stream (Stream 1) are all set to be "PL1".

FIG. 8(*b*) illustrates a configuration of an audio frame constituting the second audio stream (Stream 2). There are "Frame"s of SCE2 and EXE1 and "Config"s corresponding to the "Frame"s. "Id4" is inserted as a common element index in these "Frame"s and "Config"s. To be noted, packet label (PL) values of the "Config"s and "Frame"s in this second audio stream (Stream 2) are all set to be "PL2".

FIG. 8(*c*) illustrates a configuration of an audio frame constituting the third audio stream (Stream 3). There are "Frame"s of CPE3, SCE3, and EXE2, a "Config" corresponding to the "Frame" of CPE3, and a "Config" corresponding to the "Frame"s of SCE3 and EXE2. "Id5" is inserted as a common element index in the "Frame" of CPE3 and the "Config" corresponding thereto.

In addition, "Id6" is inserted as a common element index in the "Frame"s of SCE3 and EXE2 and the "Config" corresponding to these "Frame"s. To be noted, packet label (PL) values of the "Config"s and "Frame"s in this third audio stream (Stream 3) are all set to be "PL3".

Referring back to FIG. 7, the multiplexer 114 respectively converts the video stream output from the video encoder 112 and the three audio streams output from the audio encoder 113 into PES packets, multiplexes the video stream and the three audio streams by converting the video stream and the three audio streams into transport packets, and obtains a transport stream TS as a multiplex stream.

An operation of the stream generation unit 110 illustrated in FIG. 7 will be briefly described. Video data is supplied to the video encoder 112. In this video encoder 112, video data SV is encoded, and a video stream including encoded video data is generated.

Audio data SA is supplied to the 3D audio encoder 113. This audio data SA includes channel data and object data. In the 3D audio encoder 113, the audio data SA is encoded, and transmission data of 3D audio is obtained.

This transmission data of 3D audio includes the first data (data of the group 1) constituted by just encoded channel data, the second data (data of the group 2) constituted by just encoded object data, and the third data (data of the groups 3 and 4) constituted by encoded channel data and encoded object data (see FIG. 5).

Moreover, in this 3D audio encoder 113, three audio streams are generated (see FIG. 6 and FIG. 8). In this case, common index information is inserted in "Frame" and "Config" related to the same element in each audio stream. As a result of this, "Frame" and "Config" are associated for each element by index information.

The video stream generated in the video encoder 112 is supplied to the multiplexer 114. In addition, the three audio streams generated in the audio encoder 113 are supplied to the multiplexer 114. In the multiplexer 114, the streams supplied from respective encoders are converted into PES packets and are multiplexed by being further converted into transport packets, and thus a transport stream TS as a multiplex stream is obtained.

[Exemplary Configuration of Service Receiving Device]

Figure 9:
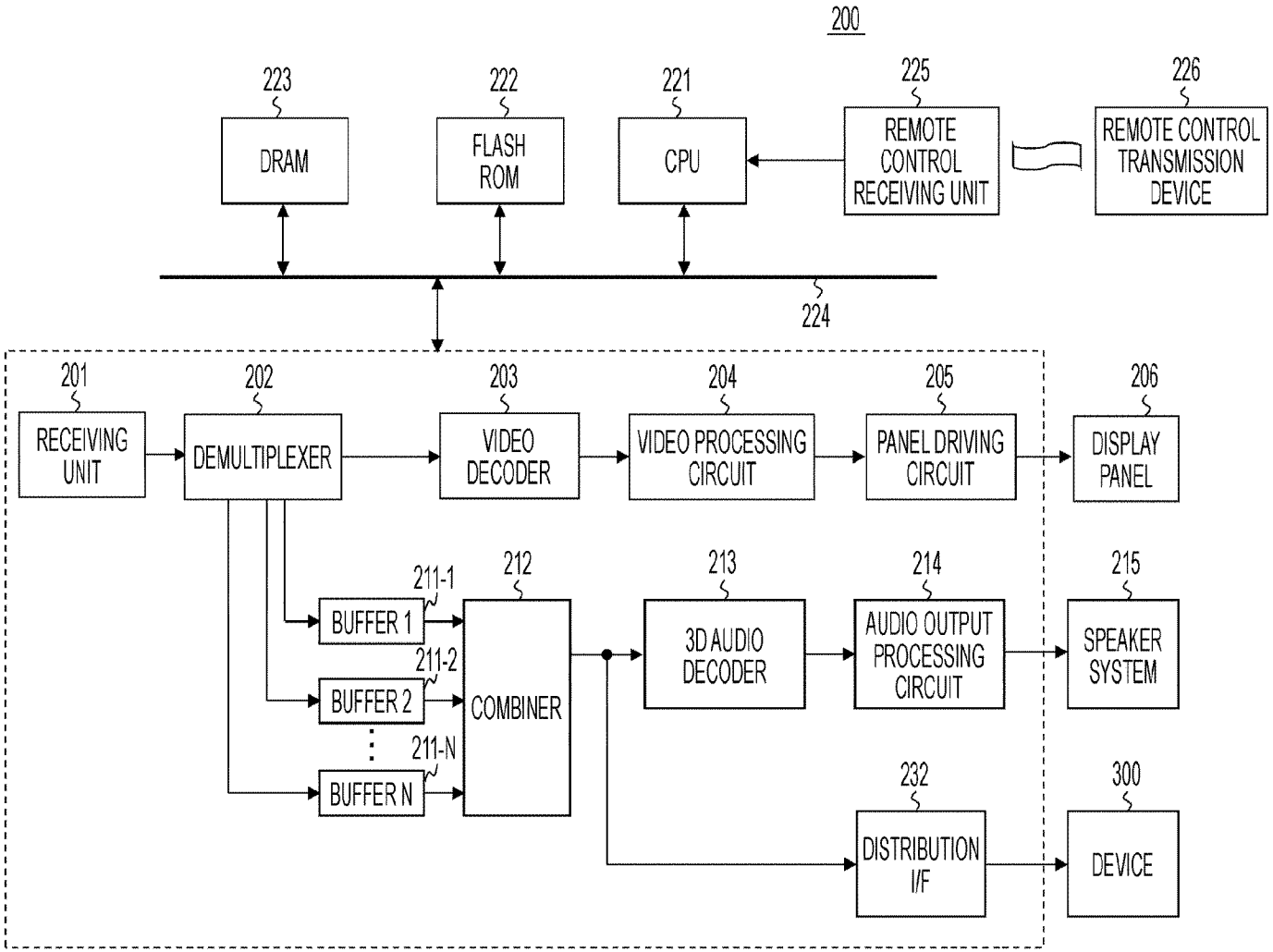
FIG. 9 is a block diagram illustrating an exemplary configuration of a service receiving device.

FIG. 9 illustrates an exemplary configuration of the service receiving device 200. This service receiving device 200 includes a CPU 221, a flash ROM 222, a DRAM 223, an internal bus 224, a remote control receiving unit 225, and a remote control transmission device 226.

In addition, this service receiving device 200 includes a receiving unit 201, a demultiplexer 202, a video decoder 203, a video processing circuit 204, a panel driving circuit 205, and a display panel 206. In addition, this service receiving device 200 includes multiplex buffers 211-1 to 211-N, a combiner 212, a 3D audio decoder 213, an audio output processing circuit 214, a speaker system 215, and a distribution interface 232.

The CPU 221 controls operation of each component of the service receiving device 200. The flash ROM 222 stores control software and keeps data. The DRAM 223 constitutes a work area of the CPU 221. The CPU 221 loads software and data read from the flash ROM 222 on the DRAM 223 to start the software, and controls each component of the service receiving device 200.

The remote control receiving unit 225 receives a remote control signal (remote control code) transmitted from the remote control transmission device 226 and supplies the remote control signal to the CPU 221. The CPU 221 controls each component of the service receiving device 200 on the basis of this remote control code. The CPU 221, the flash ROM 222, and the DRAM 223 are connected to the internal bus 224.

The receiving unit 201 receives the transport stream TS transmitted from the service transmission device 100 via a broadcasting wave or on a packet via a network. This transport stream TS includes, in addition to a video stream, three audio streams constituting transmission data of 3D audio (see FIG. 6 and FIG. 8).

The demultiplexer 202 extracts a packet of the video stream from the transport stream TS, and sends the packet to the video decoder 203. The video decoder 203 reconfigures a video stream from the packet of video extracted by the demultiplexer 202, and performs decoding processing to obtain uncompressed video data.

The video processing circuit 204 performs scaling processing, image quality adjustment processing, and so forth on the video data obtained by the video decoder 203 to obtain video data to be displayed. The panel driving circuit 205 drives the display panel 206 on the basis of image data to be displayed obtained by the video processing circuit 204. The display panel 206 is constituted by, for example, a liquid crystal display (LCD), an organic electroluminescence display, or the like.

In addition, the demultiplexer 202 selectively takes out, under the control of the CPU 221 and by a PID filter, a packet of one or plural audio streams including encoded data of a group matching a speaker configuration and audience (user) selection information among a predetermined number of audio streams included in the transport stream TS.

The multiplex buffers 211-1 to 211-N import respective audio streams taken out by the demultiplexer 202. Here, although the number N of the multiplex buffers 211-1 to 211-N is set to be a number necessary and sufficient, in an actual operation, just the number of audio streams taken out by the demultiplexer 202 will be used.

The combiner 212 takes out, for each audio frame, packets of a part or all of the "Config"s and "Frame"s from multiplex buffers in which respective audio streams taken out by the demultiplexer 202 are imported among the multiplex buffers 211-1 to 211-N, and integrates the packets into one audio stream.

In this case, in each audio stream, common index information is inserted in "Frame" and "Config" related to the same element, that is, "Frame" and "Config" are associated for each element by index information. Therefore, since the order of elements is no longer restricted by the regulation, the combiner 212 does not need to decompose the composition of audio streams to set the order of elements to comply with the regulation, and thus stream combination can be performed easily.

Figure 10:
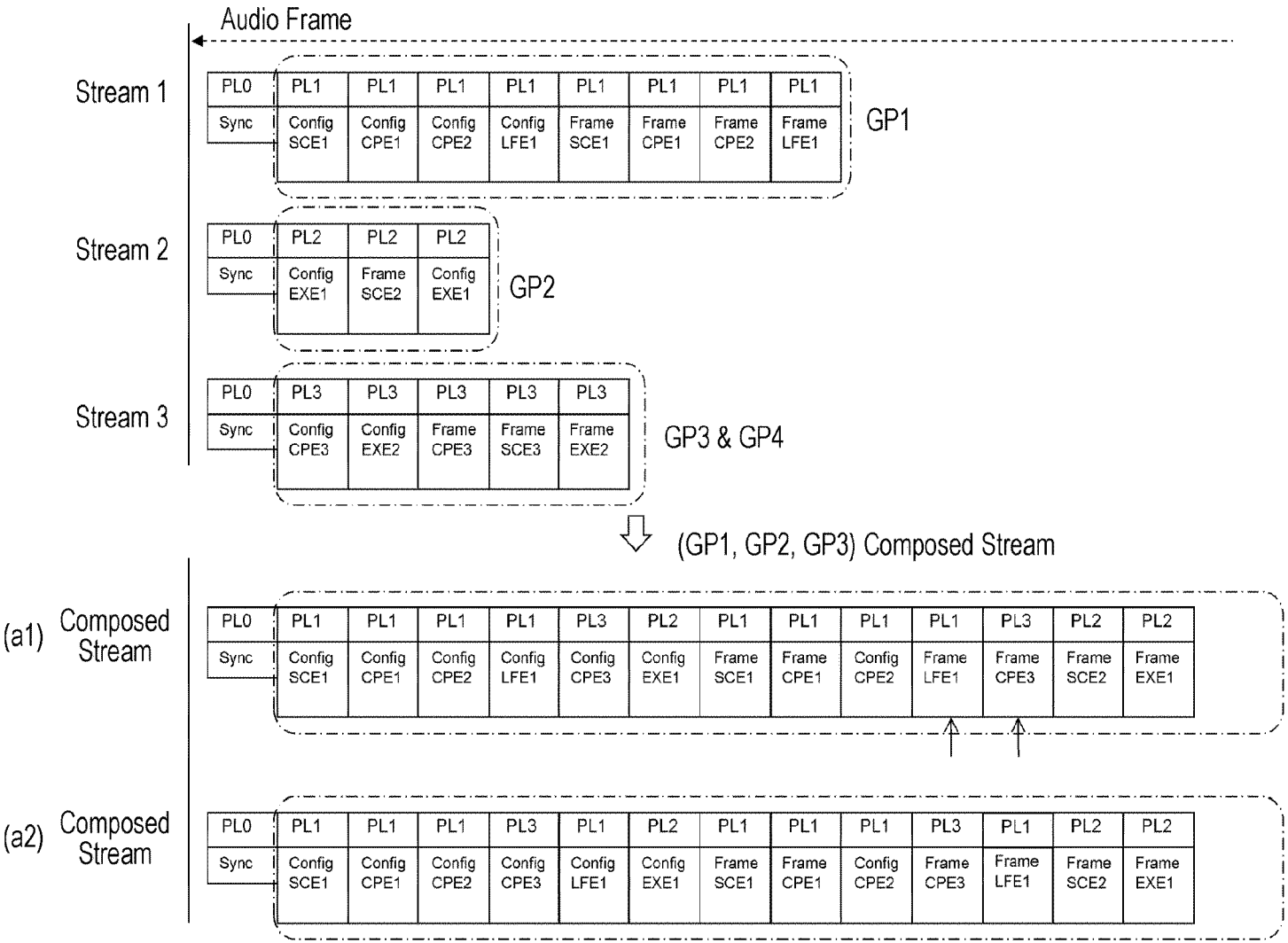
FIG. 10 is a diagram for description of an example of integration processing in a case where "Frame" and "Config" are not associated for each element by index information.

FIG. 10 illustrates an example of integration processing in a case where "Frame" and "Config" are not associated for each element by index information. This example is an example of integrating data of the group 1 included in the first audio stream (Stream 1), data of the group 2 included in the second audio stream (Stream 2), and data of the group 3 included in the third audio stream (Stream 3).

In this case, "Config" and "Frame" are not associated for each element by index information, and thus the order of elements is restricted by the regulation of the order. A composed stream of FIG. 10(*a*1) is an example in which the composition of each audio stream is integrated without being decomposed. In this case, at parts of LFE1 and CPE3 indicated by arrows, the regulation of the order of elements is violated. In this case, each element needs to be analyzed, and the order needs to be changed to CPE3→LFE1 by decomposing the composition of the first audio stream and inserting an element of the third audio stream as illustrated in a composed stream of FIG. 10(*a*2).

Figure 11:
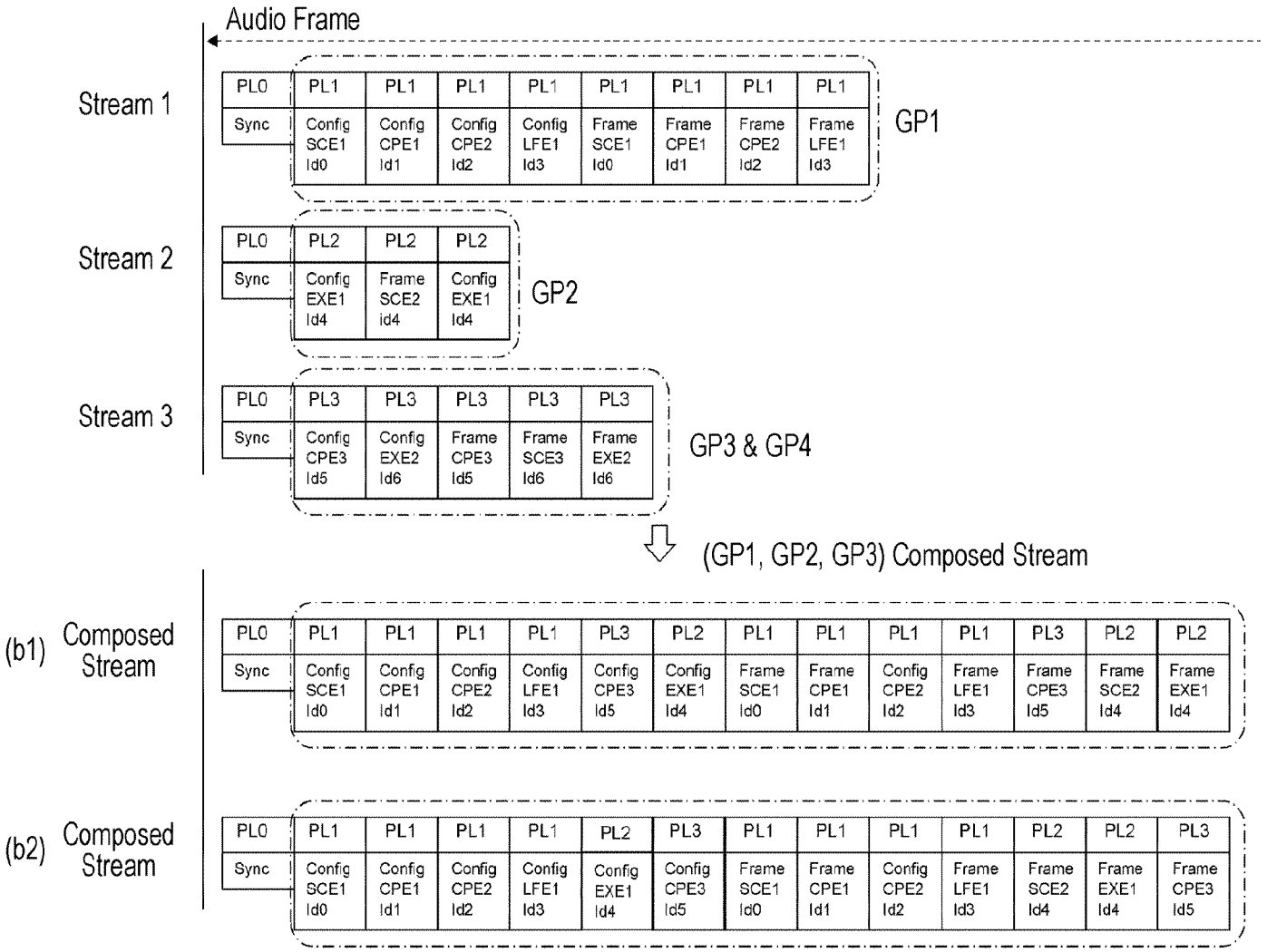
FIG. 11 is a diagram for description of an example of integration processing in a case where "Frame" and "Config" are associated for each element by index information.

FIG. 11 illustrates an example of integration processing in a case where "Frame" and "Config" are associated for each element by index information. This example is also an example of integrating data of the group 1 included in the first audio stream (Stream 1), data of the group 2 included in the second audio stream (Stream 2), and data of the group 3 included in the third audio stream (Stream 3).

In this case, "Frame" and "Config" are associated for each element by index information, and thus the order of elements is not restricted by the regulation of the order. A composed stream of FIG. 11(*a*1) is an example in which the composition of each audio stream is integrated without being decomposed. A composed stream of FIG. 11(*a*1) is another example in which the composition of each audio stream is integrated without being decomposed.

Referring back to FIG. 9, the 3D audio decoder 213 performs decoding processing on the one audio stream obtained by the integration performed by the combiner 212 and obtains audio data for driving each speaker. The audio output processing circuit 214 performs necessary processing such as D/A conversion and amplification on the audio data for driving each speaker and supplies the audio data to the speaker system 215. The speaker system 215 includes plural speakers of plural channels such as 2 channels, 5.1 channels, 7.1 channels, or 22.2 channels.

The distribution interface 232 distributes (transmits) the one audio stream obtained by the integration performed by the combiner 212 to, for example, a device 300 connected via a local area network. This local area network connection includes ethernet connection and wireless connection such as "WiFi" or "Bluetooth". To be noted, "WiFi" and "Bluetooth" are registered trademarks.

In addition, the device 300 includes a surround speaker, a second display, and an audio output device adjunct to a network terminal. This device 300 performs decoding processing similar to the 3D audio decoder 213, and obtains audio data for driving speakers of a predetermined number.

An operation of the service receiving device 200 illustrated in FIG. 9 will be briefly described. In the receiving unit 201, the transport stream TS transmitted from the service transmission device 100 via a broadcasting wave or on a packet via a network is received. In this transport stream TS, three audio streams constituting transmission data of 3D audio are included in addition to a video stream (see FIG. 6 and FIG. 8). This transport stream TS is supplied to the demultiplexer 202.

In the demultiplexer 202, a packet of the video stream is extracted from the transport stream TS, and sent to the video decoder 203. In the video decoder 203, a video stream is reconfigured from the packet of video extracted by the demultiplexer 202, decoding processing is performed, and uncompressed video data is obtained. This video data is supplied to the video processing circuit 204.

In the video processing circuit 204, scaling processing, image quality adjustment processing, and so forth are performed on the video data obtained by the video decoder 203, and video data to be displayed is obtained. This video data to be displayed is supplied to the panel driving circuit 205. In the panel driving circuit 205, the display panel 206 is driven on the basis of the video data to be displayed. As a result of this, an image corresponding to the video data to be displayed is displayed on the display panel 206.

In addition, in the demultiplexer 202, a packet of one or plural audio streams including encoded data of a group matching a speaker configuration and audience selection information among a predetermined number of audio streams included in the transport stream TS is selectively taken out by a PID filter under the control of the CPU 221.

An audio stream taken out by the demultiplexer 202 is imported by a corresponding multiplex buffer among the multiplex buffers 211-1 to 211-N. In the combiner 212, for each audio frame, packets of a part or all of the "Config"s and "Frame"s are taken out from multiplex buffers in which respective audio streams taken out by the demultiplexer 202 are imported among the multiplex buffers 211-1 to 211-N, and the packets are integrated into one audio stream.

In this case, in each audio stream, "Frame" and "Config" are associated for each element by index information, and thus the order of elements is not restricted by the regulation. Therefore, in the combiner 212, it is not required to decompose the composition of audio streams to set the order of elements to comply with the regulation, and thus stream combination is performed easily (see FIGS. 11(*b*1) and (*b*2)).

The one audio stream obtained by the integration performed by the combiner 212 is supplied to the 3D audio decoder 213. In the 3D audio decoder 213, this audio stream is subjected to decoding processing, and audio data for driving each speaker constituting the speaker system 215 is obtained.

This audio data is supplied to the audio output processing circuit 214. In this audio output processing circuit 214, necessary processing such as D/A conversion and amplification is performed on the audio data for driving each speaker. Then, the processed audio data is supplied to the speaker system 215. As a result of this, audio output corresponding to a display image on the display panel 206 is obtained from the speaker system 215.

In addition, the audio stream obtained by the integration performed by the combiner 212 is supplied to the distribution interface 232. In the distribution interface 232, this audio stream is distributed (transmitted) to the device 300 connected via a local area network. In the device 300, decoding processing is performed on the audio stream, and audio data for driving speakers of a predetermined number is obtained.

As described above, in the communication system 10 illustrated in FIG. 1, the service transmission device 100 is configured to insert common index information in "Frame" and "Config" related to the same element in a case of generating an audio stream via 3D audio encoding. Therefore, when a receiver integrates plural audio streams into one audio stream, it is not required to comply with the regulation of the order, and the processing load can be reduced.

2. Modification Example

To be noted, in the exemplary embodiment described above, an example in which a container is a transport stream (MPEG-2 TS) has been described. However, the present technology can be similarly applied to a system in which distribution is performed in a container of MP4 or another format. The examples include a MPEG-DASH-based stream distribution system and a communication system that uses an MPEG media transport (MMT) structure transmission stream.

To be noted, the present technology can employ following configurations.

(1) A transmission device including an encoding unit configured to generate a predetermined number of audio streams, and a transmission unit configured to transmit a container of a predetermined format including the predetermined number of audio streams, in which the audio streams are constituted by an audio frame including a first packet that includes encoded data as payload information and a second packet that includes configuration information representing a configuration of the payload information of the first packet as payload information, and common index information is inserted in payloads of the first packet and the second packet that are related.

(2) The transmission device according to (1), in which the encoded data that the first packet include as payload information is encoded channel data or encoded object data.

(3) A transmission method including an encoding step of generating a predetermined number of audio streams, and a transmission step of using a transmission unit to transmit a container of a predetermined format including the predetermined number of audio streams, in which the audio streams are constituted by an audio frame including a first packet that includes encoded data as payload information and a second packet that includes configuration information representing a configuration of the payload information of the first packet as payload information, and common index information is inserted in payloads of the first packet and the second packet that are related.

(4) A receiving device including a receiving unit configured to receive a container of a predetermined format including a predetermined number of audio streams, in which the audio streams are constituted by an audio frame including a first packet that includes encoded data as payload information and a second packet that includes configuration information representing a configuration of the payload information of the first packet as payload information, and common index information is inserted in payloads of the first packet and the second packet that are related, a stream integration unit configured to take out a part or all of the first packet and the second packet from the predetermined number of audio streams and integrate the part or all of the first packet and the second packet into one audio stream by using the index information inserted in payload portions of the first packet and the second packet, and a processing unit configured to process the one audio stream.

(5) The receiving device according to (4), in which the processing unit performs decoding processing on the one audio stream.

(6) The receiving device according to (4) or (5), in which the processing unit transmits the one audio stream to an external device.

(7) A receiving method including a receiving step of using a receiving unit to receive a container of a predetermined format including a predetermined number of audio streams, in which the audio streams are constituted by an audio frame including a first packet that includes encoded data as payload information and a second packet that includes configuration information representing a configuration of the payload information of the first packet as payload information, and common index information is inserted in payloads of the first packet and the second packet that are related, a stream integration step of taking out a part or all of the first packet and the second packet from the predetermined number of audio streams and integrating the part or all of the first packet and the second packet into one audio stream by using the index information inserted in payload portions of the first packet and the second packet, and a processing step of processing the one audio stream.

A main feature of the present technology is that it is enabled to reduce the processing load of stream integration processing by a receiver, in a case of generating an audio stream via 3D audio encoding, by inserting common index information in "Frame" and "Config" related to the same element (see FIG. 3 and FIG. 8).

REFERENCE SIGNS LIST

10 Communication system
100 Service transmission device

110 Stream generation unit
112 Video encoder
113 3D audio encoder
114 Multiplexer
200 Service receiving device
201 Receiving unit
202 Demultiplexer
203 Video decoder
204 Video processing circuit
205 Panel driving circuit
206 Display panel
211-1 to 211-N Multiplex buffer
212 Combiner
213 3D audio decoder
214 Audio output processing circuit
215 Speaker system
221 CPU
222 Flash ROM
223 DRAM
224 Internal bus
225 Remote control receiving unit
226 Remote control transmission device
232 Distribution interface
300 Device

The invention claimed is:

1. A transmission device for transmitting an audio stream to a speaker system having speakers present at arbitrary positions, the transmission device comprising:

an encoder configured to generate the audio stream by encoding data of the audio stream as payload information of a first packet having a decoding order, generating a second packet that includes respective configuration information for the encoded data of the first packet as payload information, and inserting common index information in both the first packet and the second packet, wherein the common index information is an index indicating the decoding order of the first packet and has a same value in both the first packet and the second packet; and a transmitter configured to transmit the audio stream including the first packet and the second packet to the speaker system.

2. The transmission device according to claim 1, wherein the encoded data included in the first packet as payload information is one of encoded single channel data, channel pair data, low frequency data, and metadata for performing rendering of the audio signals, and wherein the configuration information includes at least one of configuration information for the single channel data, configuration information for the channel pair data, configuration information for the low frequency data, and configuration information for the metadata.

3. A transmission method for transmitting an audio stream to a speaker system having speakers present at arbitrary positions, the method comprising:

generating, by an encoder, the audio stream by encoding data of the audio stream as payload information of a first packet having a decoding order, generating a second packet that includes respective configuration information for the encoded data of the first packet as payload information, and inserting common index information in both the first packet and the second packet, wherein the common index information is an index indicating the decoding order of the first packet and has a same value in both the first packet and the second packet; and transmitting, by a transmitter, the audio stream including the first packet and the second packet to the speaker system.

4. A receiving device supplying data of an audio stream to a speaker system having speakers present at arbitrary positions, the receiving device comprising:

processing circuitry configured to receive the audio stream, wherein the audio stream includes encoded data as payload information of a first packet having a decoding order, and includes a second packet that includes respective configuration information for the encoded data of the first packet as payload information, and common index information that is inserted in both the first packet and the second packet, wherein the common index information is an index indicating the decoding order of the first packet and has a same value in both the first packet and the second packet;

the processing circuitry configured to process the audio stream by using the common index information to relate the first packet to the respective configuration information of the second packet and to integrate the first packet into the audio stream according to the decoding order, and supply the audio stream to the speaker system.

5. The receiving device according to claim 4, wherein the processing circuitry performs decoding processing on the audio stream.

6. The receiving device according to claim 4, wherein the processing circuitry transmits the audio stream to an external device.

7. A receiving method supplying data of an audio stream to a speaker system having speakers present at arbitrary positions, the method comprising:

receiving, by processing circuitry, the audio stream, wherein the audio stream includes encoded data as payload information of a first packet having a decoding order, and includes a second packet that includes respective configuration information for the encoded data of the first packet as payload information, and common index information that is inserted in both the first packet and the second packet, wherein the common index information is an index indicating the decoding order of the first packet and has a same value in both the first packet and the second packet;

processing, by the processing circuitry, the audio stream by using the common index information to relate the first packet to the respective configuration information of the second packet and to integrate the first packet into the audio stream according to the decoding order, and supplying the audio stream to the speaker system.

* * * * *